United States Patent [19]

Cullings

[11] 4,099,761

[45] Jul. 11, 1978

[54] SUSPENDED MATERIAL HANDLING UNIT

[76] Inventor: Harold L. Cullings, R.D. 1, Box 66, McConnellsburg, Pa. 17233

[21] Appl. No.: 742,881

[22] Filed: Nov. 18, 1976

Related U.S. Application Data

[63] Continuation-in-part of Ser. No. 632,667, Nov. 17, 1975, Pat. No. 4,005,895.

[51] Int. Cl.[2] ..... B66C 1/00

[52] U.S. Cl. ..... 294/86 R; 294/88; 294/106; 308/163

[58] Field of Search ..... 294/65.5, 70, 82 R, 294/86 R, 88, 106, 107; 37/182–188; 214/147 G, 651, 652, 656, 657; 308/163, 237 R, 237 A, DIG. 9

[56] References Cited

U.S. PATENT DOCUMENTS

| | | | |
|---|---|---|---|
| 2,575,830 | 11/1951 | O'Malley | 308/163 |
| 2,582,433 | 1/1952 | Hitchcock | 308/237 R |
| 3,211,502 | 10/1965 | Lamson et al. | 308/237 R X |
| 3,301,587 | 1/1967 | Heikkinen | 294/82 R X |
| 3,413,029 | 11/1968 | Donovan | 294/70 |
| 3,751,099 | 8/1973 | Billings | 294/82 R X |
| 3,877,743 | 4/1975 | Johnson | 294/88 |

*Primary Examiner*—Johnny D. Cherry
*Attorney, Agent, or Firm*—Brady, O'Boyle & Gates

[57] ABSTRACT

A suspended material handling unit has a simplified, compact and economical thrust and limited rotational bearing means between relatively fixed and limited rotational components of the unit. Both lifting and down pressure reaction forces are transmitted through the double-acting thrust bearing in such a way that screws which connect a thrust bearing cap to the limited rotational component are relieved of the comparatively heavy down pressure reaction forces. The rotational bearing means immediately below the double-acting thrust bearing spans a substantial axial distance in the telescoped components and provides lateral stability in the unit.

8 Claims, 7 Drawing Figures

FIG. 1
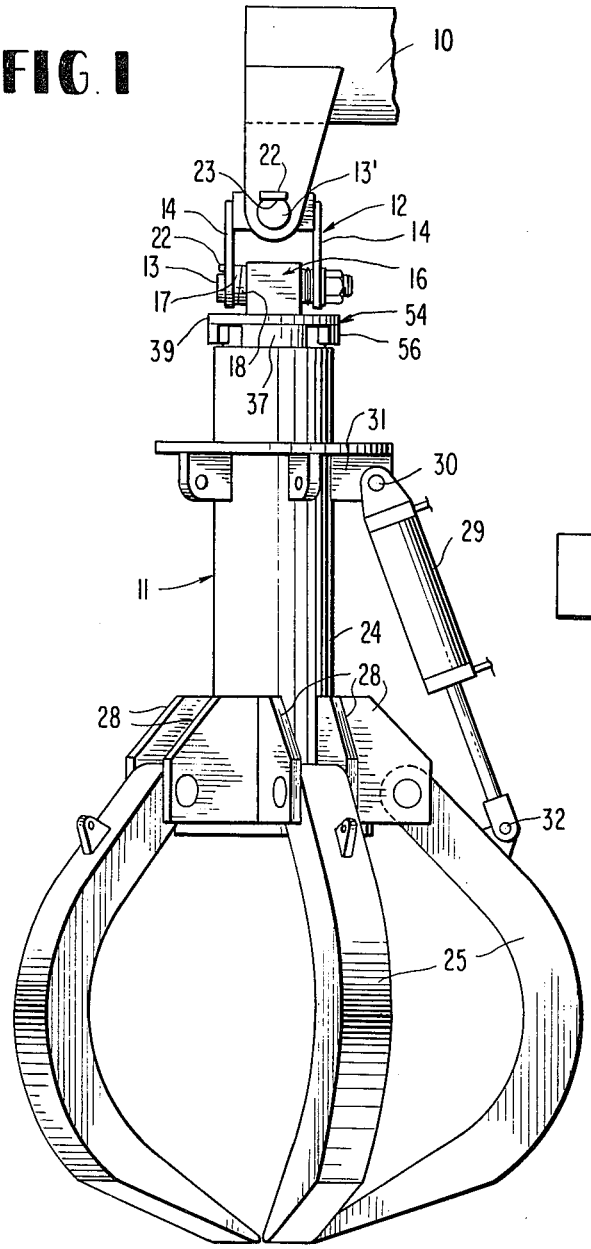
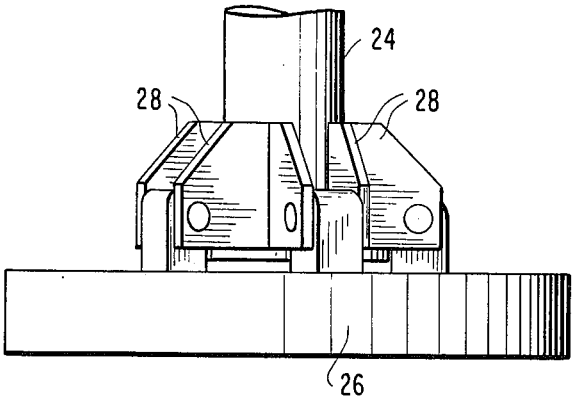
FIG. 7
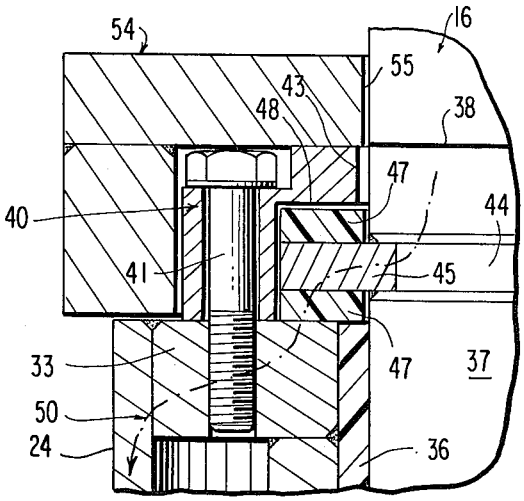
FIG. 6

FIG. 3
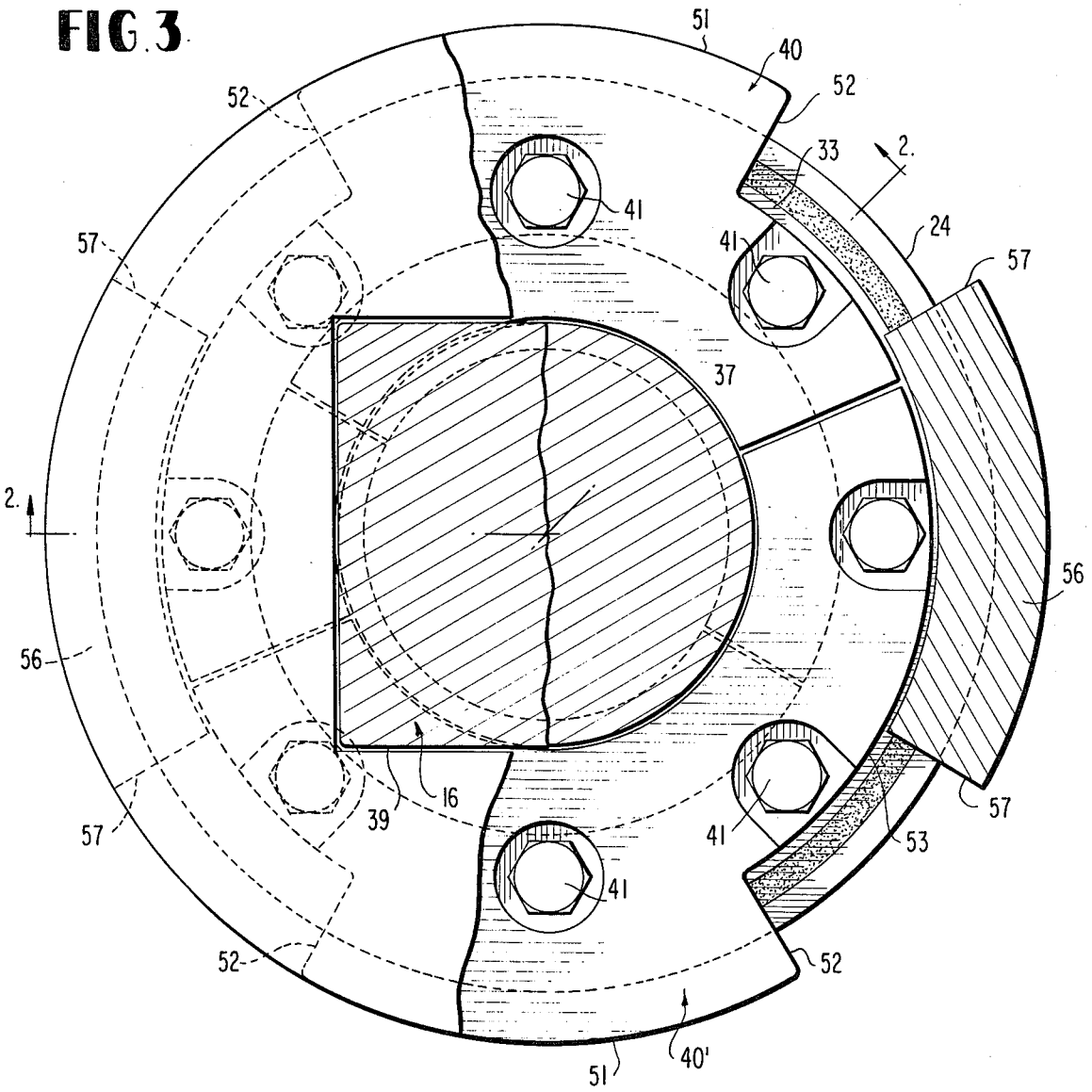
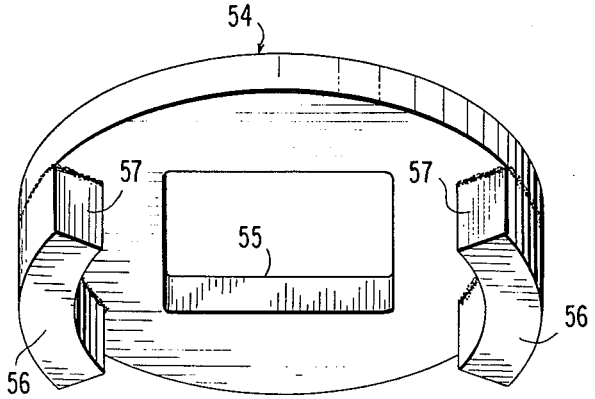
FIG. 4
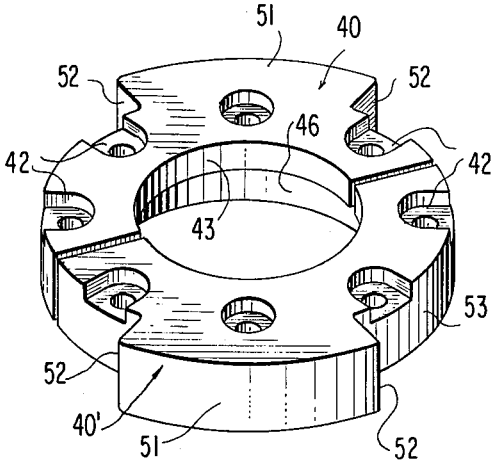
FIG. 5

SUSPENDED MATERIAL HANDLING UNIT

Cross-Reference to Related Application

This application is a continuation-in-part of prior copending application Ser. No. 632,667, filed Nov. 17, 1975 for ROTATIONAL GRAPPLE, now U.S. Pat. No. 4,005,895.

BACKGROUND OF THE INVENTION

A need exists in the art for a more simplified and economical suspended type material handling unit for use in scrap yards and other like applications. Such a simplified suspended lifting device should be capable of withstanding heavy reaction forces resulting from lifting a load and even heavier reaction forces resulting from down pressure on the unit, as when a boom supporting the unit presses the unit downwardly. The simplified device in contemplated applications does not require positive rotational drive means as disclosed in the above-referenced copending application. However, it should be capable of at least limited rotational self-adjustment, as when being brought into engagement with a pile of scrap material with haphazardly arranged pieces. The device should be embodied in a mechanical grapple having power-operated grapple arms and preferably should be easily convertible to a magnetic type lifting unit.

In view of the above need in the art, the present invention seeks to improve upon the known prior art including the device of the referenced patent application by providing a suspended material handling or lift unit which possesses all of the above-discussed requirements for a more economical and less complicated lift or handling unit for scrap yards and like operations.

A further objective of this invention is to provide such an improved and simplified device which loses none of its ruggedness, strength and durability compared to the more costly and complex prior art equipment.

Other features and advantages of the invention will appear to those skilled in the art during the course of the following description.

SUMMARY OF THE INVENTION

The present invention is embodied in a suspended handling or lift unit in which relatively fixed and limited rotational components are telescopically connected and suspended in assembled relationship from a movable overhead support, such as the boom of a power construction or excavating machine. Means are embodied in the device to positively limit free relative rotation between the telescopically engaged components while allowing sufficient relative rotation to render the device selfadjusting relative to pieces of scrap or other material to be lifted.

The unit possesses, as a major feature of the invention, a simplified, compact and very strong double-acting thrust bearing between the relatively rotatable components and an adjacent rotational bearing immediately below the thrust bearing and spanning a substantial axial distance between the telescopically engaged components to afford adequate lateral stability to the device. The thrust bearing can transmit reaction forces caused by lifting a load as well as reaction forces resulting from down pressure on the device. These latter forces are frequently more severe and in the invention screws which attach a thrust bearing cap to the top of the limited rotational component are relieved of the heavy down pressure reaction forces due to the unique geometry of the bearing means.

BRIEF DESCRIPTION OF THE DRAWINGS

FIG. 1 is a side elevation of a suspended material handling unit or grapple embodying the invention.

FIG. 3 is a horizontal section taken on line 3—3 of FIG. 2.

FIG. 4 is a perspective view of a relatively stationary rotation limiting plate with positive stop elements thereon.

FIG. 5 is a perspective view of a divided stop plate also forming a thrust bearing retainer cap and attached to the rotational component of the device.

FIG. 6 is a fragmentary vertical section, similar to FIG. 2, showing the double-acting thrust bearing resisting down pressure on the device, FIG. 2 showing the thrust bearing resisting forces resulting from lifting.

FIG. 7 is a fragmentary side elevation of a lifting magnet which may be employed in lieu of the mechanical grapple arms shown in FIG. 1 and their associated power cylinders.

DETAILED DESCRIPTION

Figure 2:
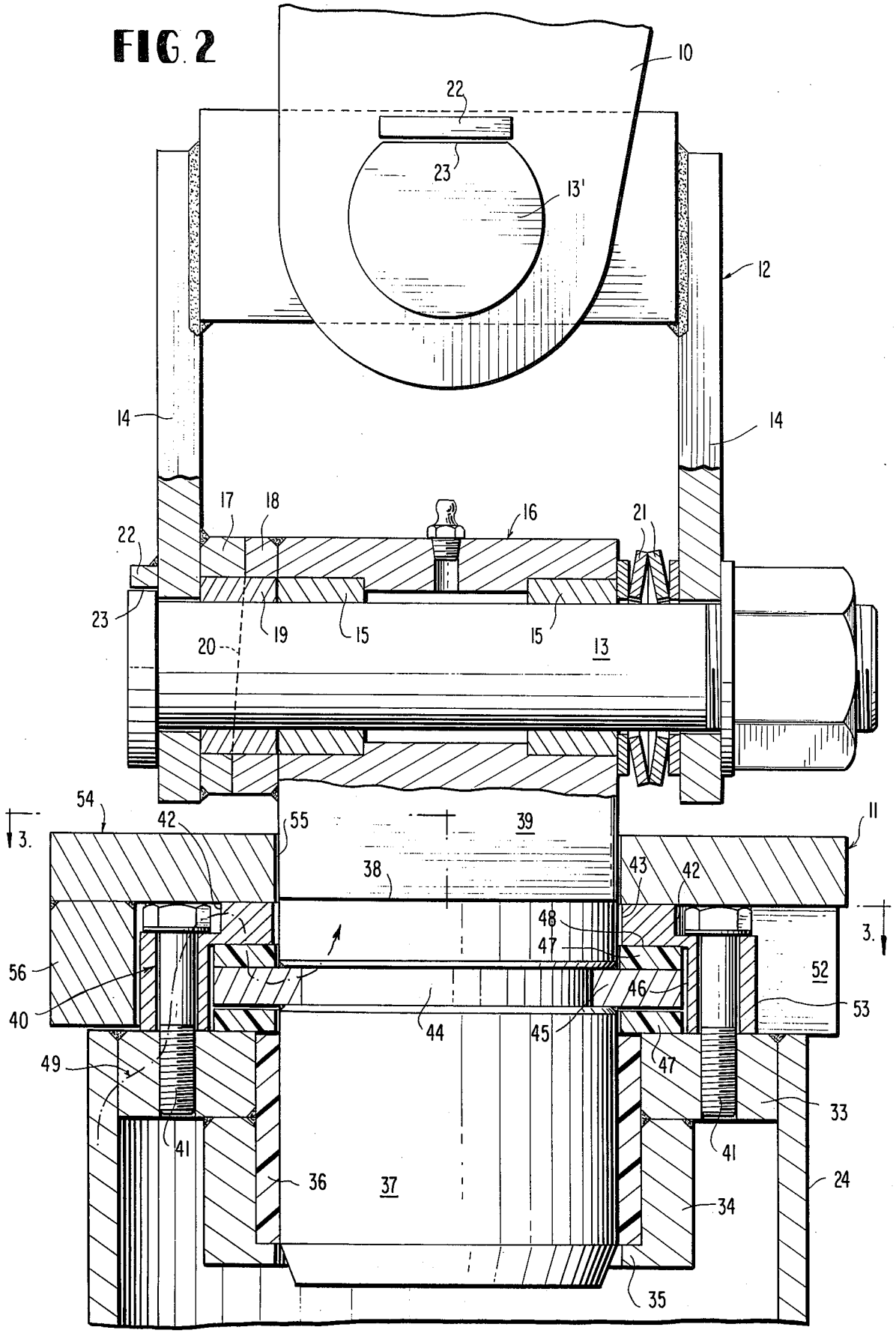
FIG. 2 is an enlarged vertical cross section taken on line 2—2 of FIG. 3.

Referring to the drawings in detail, wherein like numerals designate like parts, and referring first to FIG. 1, the numeral 10 designates an overhead movable support for the invention, such as the power boom of a construction or excavating machine. The invention proper designated in its entirety by the numeral 11 is suspended freely from the support 10 by a dual axis universal suspension unit 12. Preferably, this universal suspension means includes a lower pivot or suspension pin 13 extending through apertured side plates 14 of the unit 12 and engaged within spaced bearings 15 seated in the opposite sides and top portion of a vertical shaft member 16 which is the relatively fixed or nonrotational component of the suspended lifting device 11. In order to dampen swinging of the device 11 on the axis of pin 13, opposing cam rings 17 and 18 are welded, respectively, to the adjacent side plate 14 and the side face of shaft member 16 whose upper portion is rectangular in cross section as best shown in FIG. 3. A retainer sleeve 19 for one bearing 15 in the nature of a spacer is interposed between that bearing and the near plate 14 and engages through the coaxial bores of cam rings 17 and 18. The two cam rings are relatively rotatable when the device 11 tends to swing on the axis of the pin 13. When this relative rotation occurs, the opposed camming faces 20 of the rings 17 and 18 tend to shift the shaft member 16 and its bearings axially on the pin 13 toward the far plate 14. This shifting is resisted by a pair of strong Belleville spring washers 21, or equivalent means, and the arrangement tends automatically to dampen the swinging of the lifting device on the axis of pin 13 and to return the same quickly to a neutral non-swinging position with the two cam rings at rest. A fixed lug 22 on the adjacent plate 14 coacts with a flat 23 on the head of pin 13 to prevent rotation of the pin on its axis. The same arrangement is provided for the upper pin 13' of the universal suspension unit 12.

The suspended lifting device 11 further comprises a limited rotational sleeve 24 of considerable length which is adapted to carry at its lower end either the mechanical grapple arms 25 of FIG. 1 or a lifting magnet 26 as shown in FIG. 7. Pairs of rigid apertured lugs 28 on the lower end portion of the sleeve 24 support the grapple arms or the magnet interchangeably, as shown. The pivoted grapple arms 25 are conventionally operated by hydraulic cylinders 29 whose cylinder ends are attached at 30 to fixed lugs 31 on the sleeve 24 considerably above the lugs 28. The rod ends of cylinders 29 are similarly attached at 32 to the grapple arms so that they may be swung apart or drawn together by convenional hydraulic controls, not shown.

The sleeve 24 has a sturdy head plate 33 welded into its bore at its top end. A short sleeve 34 of lesser diameter is welded to the bottom of head plate 33 coaxially of the sleeve 24 and has a lower end support flange 35 thereon for the support of a rotational sleeve bearing 36 held within the bores of head plate 33 and sleeve 34, as best shown in FIG. 2. The sleeve bearing 36 is preferably a phenolic bearing or an equivalent dry lube bearing. It serves to journal a lower cylindrical portion 37 of non-rotatable shaft member 16 over a considerable distance, such as a longitudinal distance equivalent to at least half the diameter of the lower cylindrical portion 37, where the shaft member is telescopically engaged with the limited rotational sleeve 24, thus providing lateral stability to the lifting device. It can be seen in FIG. 2 that the shaft member 16 has a median transition line 38 where the rectangular upper portion 39 of the shaft member is joined to the lower cylindrical portion 37. This transition line is somewhat above the elevation of the sleeve head plate 33.

A divided two piece thrust bearing retainer plate 40–40′ also serving as a stop plate is secured fixedly and removably to the top face of sleeve 24 and head plate 33 by a plurality of curcumferentially spaced screws 41 whose heads are recessed below the top face of plate sections 40–40′ as at 42, FIG. 5. The bore 43 of plate sections 40–40′ surrounds the cylindrical portion 37 of shaft member 16 below the transition line 38 with some clearance. The cylindrical portion 37 of shaft member 16 has an annular recess 44 formed therein slightly above the head plate 33 and a sturdy split thrust bearing reaction ring 45 is welded in place within the recess or groove 44 and projects radially outwardly of shaft section 37 and into an internal annular recess 46 of the two part plate 40–40′.

Upper and lower identical thrust bearing rings 47 of phenolic material or the like are also received in the recess 46 on opposite sides of the reaction ring 45, the upper thrust bearing ring 47 engaging an annular radial face 48 at the top of recess 46, and the lower bearing ring 47 engaging the flat top face of head plate 33. The two bearing rings 47 fit loosely around cylindrical portion 37 of shaft member 16. It can be seen that the rotational sleeve bearing 36 is placed immediately below the thrust bearing structure and the total bearing arrangement is compact and stable.

FIG. 2 shows the condition of the thrust bearing consisting of elements 45 and 47 when the suspended lifting unit 11 is carrying a load. The load reaction force line for this situation is approximately illustrated at 49 in FIG. 2. The force line is from the load through the sleeve 24, through the bolts 41 and divided bearing retainer plate 40–40′, through the upper thrust bearing ring 47 and reaction plate 45 and, finally, into and through the shaft member 16 to the overhead support. It can be noted in FIG. 2 that when the device 11 is loaded, the element 45 and upper thrust bearing ring 47 are stacked against the face 48 while there is some clearance between the lower thrust bearing ring 47 and the reaction plate 45. The lower bearing ring 47 is unloaded.

FIG. 6 depicts the condition where down pressure is exerted through the lifting device 11 such as when the device is being forced downwardly against a pile of scrap material. This usually results in heavier reaction forces through the device than those created when a load is being lifted. In FIG. 6, the down pressure reaction force line is approximately illustrated at 50. The force line is through the sleeve 24 and head plate 33 and across but not through the bolts 41, through the lower bearing ring 47 and the thrust bearing reaction plate 45 and into and through the shaft member 16. With this arrangement, the upper bearing ring 47 is unloaded and slightly spaced from the surface 48 while the lower ring 47 and the element 45 are stacked against the top face of head plate 33. The bolts 41 in FIG. 6 are relieved of the comparatively heavy load or force resulting from down pressure. It is now clear that the described thrust bearing is double-acting and has a unique mode of operation. It is also simple and compact in construction.

As previously noted, the divided thrust bearing retainer plate 40–40′ serves the additional purpose of a positive stop or limiting means for the rotational movement of the sleeve 24 and all parts carried thereby. The plate 40–40′ being fixed to the sleeve 24 by bolts 41 turns therewith. Its two sections carry integral diametrically opposed stop segments 51 having end stop faces 52, FIG. 5. The stop faces 52 are in radial planes and project beyond the peripheral face 53 of the divided plate 40–40′.

Cooperating with the rotational plate 40–40′ is an upper unitary rotational limit stop plate 54, FIG. 4, having a central rectangular opening 55 adapted to fit loosely over the rectangular portion 39 of shaft member 16. The plate 54 rests by gravity on top of the coacting divided plate 40–40′ and requires no further support or attaching means.

The plate 54 carries a pair of depending arcuate rigid stop segments 56 at diametrically opposite sides thereof and these stop segments have radial end faces 57 which are opposed to the end faces 52 of the rotational assembly, above-described. The stop plate 54 cannot rotate, as it is locked to the rectangular portion 39 of shaft member 16 by the rectangular opening 55. Consequently, referring to FIG. 3, it will be seen that rotation of the sleeve 24 in either direction around the axis of relatively fixed shaft member 16 is positively limited by engagement of one opposing pair of stop faces 52 and 57. FIG. 3 shows that the segments 56 are about midway between the coacting segments 51 and the sleeve 24 can turn in either direction from this condition for roughly 30 degrees of rotation. Approximately 60 degrees of total free rotation is allowed by the simple rotation limiting means above-described.

In light of the detailed description, it should be apparent that the entire invention is characterized by simplicity, compactness, ease of assembly, and comparative economy of manufacturing, in contrast to some prior art devices which are very complex and costly and considerably more fragile.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention clamed.

I claim:

1. A suspended material handling unit comprising a relatively stationary shaft member having a lower end cylindrical portion, means to suspend the relatively stationary shaft member along a vertical axis in free swinging relationship to a movable overhead support, a rotational sleeve member having telescoped engagement with the lower end cylindrical portion of said relatively stationary shaft member, a first thrust bearing element interposed between the telescoped members, a thrust reaction plate below said first thrust bearing element and being fixedly secured to said relatively stationary shaft member, a second thrust bearing element below said reaction plate and between the reaction plate and an opposing face of said rotational sleeve member, a thrust bearing retainer element above said first thrust bearing element and surrounding said relatively stationary shaft member and being secured to an opposing face of said rotational sleeve member, lateral rotational bearing means coaxial with and interposed between said lower end cylindrical portion and adjacent telescoped portion of said rotational sleeve member and positioned below said second thrust bearing element and spanning a substantial distance axially of the telescoped members, an upper stop member surrounding said relatively stationary shaft member and locked thereto against rotation relative to the shaft member, a cooperative rotational lower stop member fixedly secured to said rotational sleeve member in surrounding relationship to said first and second thrust bearing elements and thrust reaction plate and also constituting said thrust bearing retainer element and adapted to contact said upper stop member for restricting relative rotational movement between said shaft an sleeve members in opposite directions, and material lifting and transporting means on the lower end of said rotational sleeve member.

2. A suspended material handling unit as defined in claim 1, and at least said second thrust bearing element below said thrust reaction plate being formed of dry lube bearing material.

3. A suspended material handling unit comprising a relatively stationary member, means to suspend the relatively stationary member in free swinging relationship to a movable overhead support, a rotational member having telescoped engagement with the relatively stationary member, a first thrust bearing element interposed between th telescoped members, a thrust reaction plate below said first thrust bearing element and being fixedly secured to said relatively stationary member, a second thrust bearing element below said reaction plate and between the reaction plate and an opposing face of said rotational member, a thrust bearing retainer element above first thrust bearing element and surrounding said relatively stationary member and being secured to an opposing face of said rotational member, projecting stop elements on said thrust bearing retainer element spaced circumferentially in alignment wth said first and second thrust bearing elements and said thrust reaction plate, a coacting stop member freely resting on said thrust bearing retainer element and locked against rotation relative to said stationary member and having circumferentially spaced projecting stop parts in the path of movement of said projecting stop elements, lateral rotational bearing means coaxial with and disposed between said telescoped members and positioned below said second thrust bearing element an spanning a substantial distance axially of the telescoped members, and material lifting and transporting means on the lower end of said rotational member.

4. A suspended material handling unit comprising a relatively stationary member, means to suspend the relatively stationary member in free swinging relationship to a movable overhead support, a rotational member having telescoped engagement with the relatively stationary member, a first thrust bearing element interposed between the telescoped members, a thrust reaction plate below said first thrust bearing element and being fixedly secured to said relatively stationary member, a second thrust bearing element below said reaction plate and between the reaction plate and an opposing face of said rotational member, a thrust bearing retainer element above said first thrust bearing element and surrounding said relatively stationary member and being secured to an opposing face of said rotational member, circumferentially spaced projecting stop elements on said thrust bearing retainer element, a coacting stop member freely resting on said thrust bearing retainer element and having circumferentially spaced projecting stop parts in the paths of movement of said projecting stop elements, said stationary member having a portion of non-circular cross-section and said coacting stop member having an opening matching the cross-sectional shape of said portion and receiving said portion and interlocked therewith against rotation relative thereto, lateral rotational bearing means coaxial with and disposed between said telescoped members and positioned below said second thrust bearing element and spanning a substantial distance axially of the telescoped members, and material lifting and transporting means on the lower end of of said rotational member.

5. A suspended material handling unit comprising a relatively stationary member, means to suspend the relatively stationary member in free swinging relationship to a movable overhead support, a rotational member having telescoped engagement with the relatively stationary member, a first thrust bearing element interposed between the telescoped members, a thrust reaction plate below said first thrust bearing element and being fixedly secured to said relatively stationary member, a second thrust bearing element below said reaction plate and between the reaction plate and an opposing face of said rotational member, a thrust bearing retainer element above said first thrust bearing element and surrounding said relatively stationary member and being secured to an opposing face of said rotational member, diametrically opposed projecting circumferential segments on said thrust bearing retainer element and having radial end stop faces, a coacting stop member freely resting on said thrust bearing retainer element and locked against rotation relative to said stationary member, diametrically opposed circumferential segments depending from said coacting stop member and having radial end faces in the paths of movement of the radial end stop faces, lateral rotational bearing means coaxial with and disposed between said telescoped members and positioned below said second thrust bearing element and spanning a substantial distance axially of the telescoped members, and material lifting and transporting means on the lower end of said rotational member.

6. A suspended material handling unit comprising a relatively stationary shaft member having a lower end cylindrical portion, means to suspend the relatively stationary shaft member in free swinging relationship to a movable overhead support, a rotational sleeve member having telescoped engagement with the lower end cylindrical portion of said shaft member, a first thrust bearing element interposed between the telescoped members, a thrust reaction plate below said first thrust bearing element and being fixedly secured to said shaft member, a second thrust bearing element below said reaction plate and between the reaction plate and an opposing face of said rotational sleeve member, a thrust bearing retainer element above said first thrust bearing element and surrounding said shaft member and being secured to an opposing face of said rotational sleeve member, a lateral rotational sleeve bearing coaxial with and interposed between said lower end cylindrical portion and adjacent telescoped portion of said rotational sleeve member, a head plate fixed within the upper end of the sleeve member and forming a base for said second thrust bearing element and for said thrust bearing retainer element, said head plate having a bore receiving said sleeve bearing immediately below said second thrust bearing element, said sleeve bearing spanning a substantial distance axially of the telescoped members, and material lifting and transporting means on the lower end of said rotational sleeve member.

7. A suspended material handling unit as defined in claim 6, and circumferentially spaced screws connecting said thrust bearing retainer element to said head plate.

8. A suspended material handling unit as set forth in claim 6 in which said sleeve bearing comprises a dry lube sleeve bearing.

* * * * *